US006968071B2

(12) United States Patent
Wang

(10) Patent No.: US 6,968,071 B2
(45) Date of Patent: Nov. 22, 2005

(54) SPEAKER HAVING MAGNETIC MEMBER INSTALLED ON DIAPHRAGM

(76) Inventor: Chao-Lang Wang, 3rd Floor, No. 12, Lane 91, Shi-Tung Road, Shih-Lin Dist., Taipei (TW)

( * ) Notice: Subject to any disclaimer, the term of this patent is extended or adjusted under 35 U.S.C. 154(b) by 351 days.

(21) Appl. No.: 10/342,362

(22) Filed: Jan. 15, 2003

(65) Prior Publication Data

US 2004/0136561 A1 Jul. 15, 2004

(51) Int. Cl.[7] ..... H04R 25/00
(52) U.S. Cl. ..... 381/423; 381/413
(58) Field of Search ..... 381/396, 398, 381/400–409, 412–414, 416–424

(56) References Cited

U.S. PATENT DOCUMENTS 2,951,190 A * 8/1960 Baermann ..... 381/420
4,000,381 A * 12/1976 Plice et al. ..... 381/418
5,809,157 A * 9/1998 Grumazescu ..... 381/412
6,389,148 B1 * 5/2002 Yoo et al. ..... 381/417

* cited by examiner

*Primary Examiner*—Suhan Ni
(74) *Attorney, Agent, or Firm*—Bacon & Thomas, PLLC

(57) ABSTRACT

The present invention relates a speaker having a diaphragm around the rim of a frame on the speaker for disposing a magnetic member at the center of the diaphragm along the direction of a resonant space enclosed by the diaphragm and the frame. When a winding in the center of the frame is excited, the resonant space generates varying magnetic lines and an attraction-repulsion effect is generated in the center of the winding or a reserved space at the position of the periphery to vertically slide the magnetic member and cause the diaphragm to vibrate and generate sound. The present invention can effectively reduce the space occupied by the components such as the seat, core, and magnetic member, and greatly reduce the thickness of the speaker.

10 Claims, 7 Drawing Sheets

SPEAKER HAVING MAGNETIC MEMBER INSTALLED ON DIAPHRAGM

BACKGROUND OF THE INVENTION

1. Field of the Invention

The present invention relates to a speaker, more particularly to a speaker having a magnetic member installed on its diaphragm.

2. Description of the Related Art

A conventional cone-shaped speaker 10 construction is shown in FIG. 1, which comprises a metal frame 11 in the periphery, a recessed resonant space 12 in the center enclosed by the metal frame 11, a diaphragm 13 enclosed by the metal frame 11 being recessed on top of the resonant space 12, a slidable sleeve 14 having one end connected to the center of diaphragm 13, a winding, 15 wound around the other end of sleeve 14, a circular corrugated damping film 16 around the sleeve 14 between the diaphragm 13 and winding 15, the damping film 16 being extended radially such that the outer circumference thereof is engaged with the metal frame 11 in a predetermined position within the resonant space 12, an opening 17 on the central bottom portion of metal frame 11, a seat 18 connected to the periphery of opening 17, a first through hole 19 corresponding to adjacent opening 17 on the top side of seat 18 such that the portion of sleeve 14 having winding 15 wound thereon may insert into seat 18 through the bores of opening 17 and first through hole 19, a second through hole 20 on the bottom side of seat 18, a metal core 21 with a T-shaped cross-section having the vertical portion (i.e., post) 211 passed through the second through hole 20 and the bore of the portion of sleeve 14 having winding 15 wound thereon, and a permanent magnet 22 wound around the seat 18. The cross-sectional view of the above mentioned conventional speaker 10 is further shown in FIG. 2. The winding 15 is excited to generate an electromagnetic effect when an electric current is flowed through. Then first magnetic lines are generated in the winding 15. Also, second magnetic lines are generated in the permanent magnet 22. Such first and second magnetic lines co-act each other to create a continuous attraction-repulsion effect. As such, the sleeve 14 having winding 15 wound thereon may slide vertically as magnitude and direction of current applied thereon being changed. In turn, the diaphragm 13 is vibrated to generate sound for outputting through speaker 10.

The seat 18, core 21, and permanent magnet 22 of the conventional speaker 10 are bulky and mounted on the side of metal frame 11 opposite the diaphragm 13, thus inhibiting the further reduction of speaker size especially the thickness thereof. The portion of sleeve 14 having winding 15 wound thereon is inserted into the seat 18 sandwiched between the limited gap between the post 211 of core 21 and the permanent magnet 22. This increases the difficulty in assembly. Also, a not precisely maintained gap may adversely affect the quality of speaker 10. The position of core 21 around the seat 18 restricts the travel of sleeve 14. As such, the portion of sleeve 14 having winding 15 wound thereon may collide core 21 when speaker 10 outputs high-power low-frequency sound waves. Such collision may deform sleeve 14 after a predetermined time of use, thereby degrading the output sound quality of speaker 10. Such problems not only make the traditional speaker 10 unable to significantly reduce its size, but also make the breakthrough of the bottleneck on the design for the quality and volume of output sound very difficult.

In view of the above description about the shortcomings of the prior art, the present inventor has disclosed a speaker 30 in his U.S. Pat. No. 6,415,037, as referring to FIG. 2. The speaker 30 comprises a metal frame 31 in the periphery, a diaphragm 32 enclosed by the peripheral frame 31, a resonant space 33 in the center enclosed by frame 31 and diaphragm 32, a winding 34 installed to the inner side of the center of the frame 31 and a resonant space 33 on the center, wherein the winding 34 is excited to generate magnetic lines in the center when an electric current is flowed through. Then a continuous attraction-repulsion effect is generated in the magnetic member 35 corresponding to the winding 34. In turn, the diaphragm 32 is vibrated to generate sound for outputting through the speaker 30.

According to the speaker 30 disclosed in the U.S. Pat. No. 6,415,037, since the magnetic member 35 is directly or indirectly fixed on the center of the diaphragm 32 such that the space occupied by the seat 18, the core 21 and the permanent magnet 22 on the conventional speaker 10 as shown in FIG. 1 can be effectively reduced, thereby significantly reducing the thickness and the weight of the speaker. In addition, since the speaker 30 disclosed in the U.S. Pat. No. 6,415,037 has a winding 34 fixed and installed on a frame 31 corresponding to the inner side of the center of the diaphragm 32, therefore, when the winding 34 is excited, it creates an attraction-repulsion effect directly on the magnetic member 35 and drives the diaphragm to vibrate and generate sound. Such arrangement thus can effectively simplify the structure of the speaker, lower the cost, increase the travel of the diaphragm, prevent distortion, significantly enhance the low-frequency characteristics, and increase the power in order to break through the bottleneck of the design of the conventional speaker.

SUMMARY OF THE INVENTION

However, the design disclosed by the inventor in the U.S. Pat. No. 6,415,037 further requires improvements, and thus the inventor thought of another speaker assembly that mounts a magnetic member onto the diaphragm.

The primary objective of the present invention is to provide a speaker having a diaphragm disposed around the periphery of a frame on one lateral side of the speaker, such that the diaphragm and the frame enclose a resonant space, and a magnetic member disposed at the center of the diaphragm and along the direction of the resonant space, thereby when a winding in the middle of the inner side of the frame is excited, the resonant space generates varying magnetic lines, so that an attraction-repulsion effect is generated in the middle of the winding or the reserved space at the position of the periphery to vertically slide the magnetic member and cause the diaphragm to vibrate and generate sound. Therefore, the present invention can effectively reduce the space occupied by the components such as the seat, core, and magnetic member of the conventional speaker, and greatly reduce the thickness or the speaker.

The secondary objective of the present invention is to provide a corrugated damping film around the sleeve adjacent to the diaphragm, which extends along the radial direction and engages to an appropriate position in the resonant space of the frame. The frame is disposed at the bottom center of the resonant space and has a through hole. A corrugated damping film is disposed around the periphery of the through hole, and one end of the magnetic member facing the resonant space has a link rod with one end passing through the through hole reserved at the center of the winding and fixed onto the central position of the damping film. When the winding is excited and the winding generates varying magnetic lines at the center of the resonant space, the magnetic member slides vertically and steadily in another through hole at the center of the winding by the balance of the damping film and the auxiliary damping film to vibrate the diaphragm and generate sound. This can totally avoid the deviation occurred when the sleeve vibrates vertically and also can effectively increase the travel of the diaphragm and stability, prevent distortion, and significantly enhance the power, quality, and volume of the speaker.

A further objective of the present invention is to install a core around the periphery of the winding, so that when the winding is excited, the core can effectively increase the density of magnetic lines generated at the center of the resonant space to significantly increase the power of the speaker.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
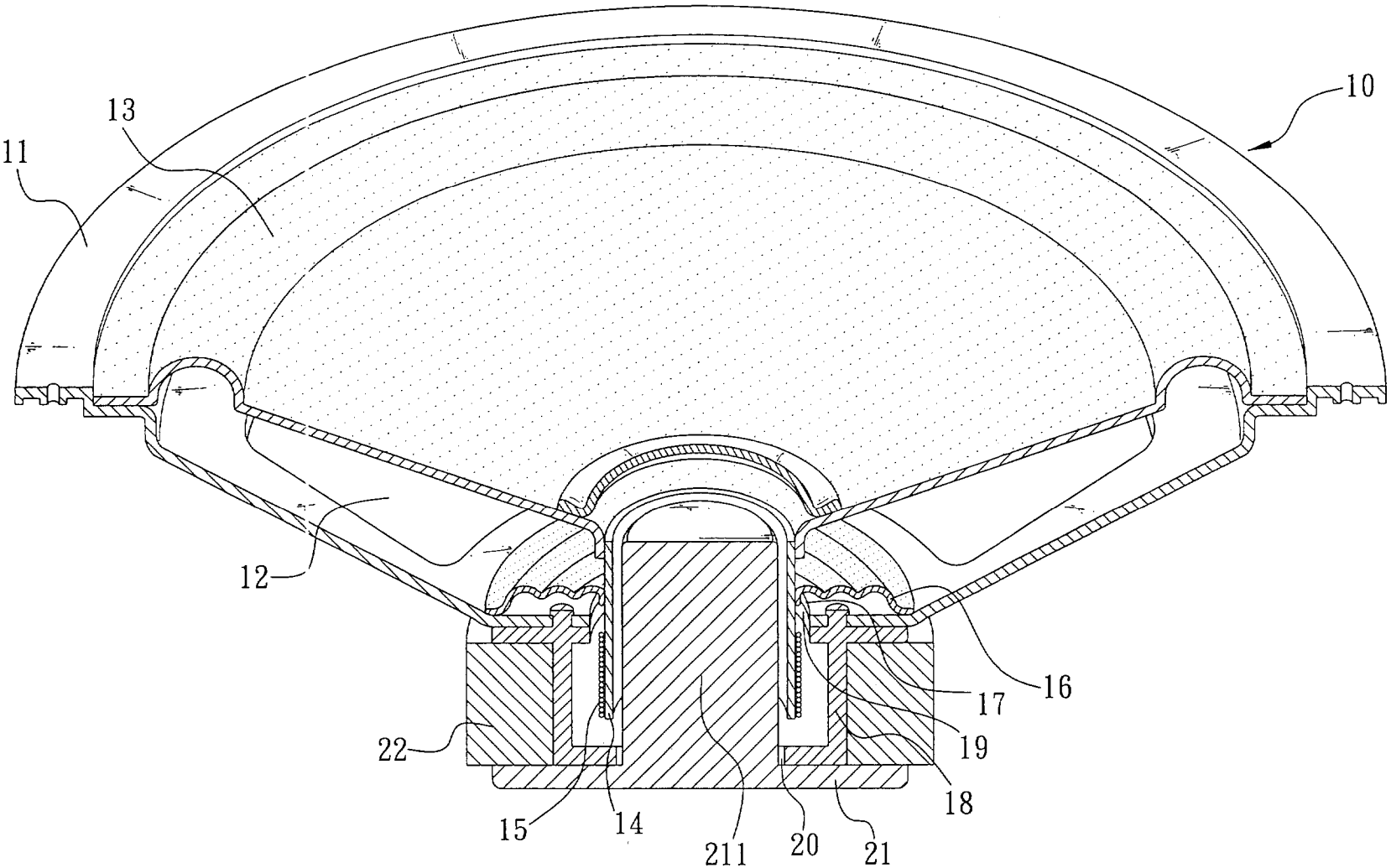
FIG. 1 (Prior Art)
FIG. 1 is a cross-sectional diagram of a prior art speaker.
Figure 2:
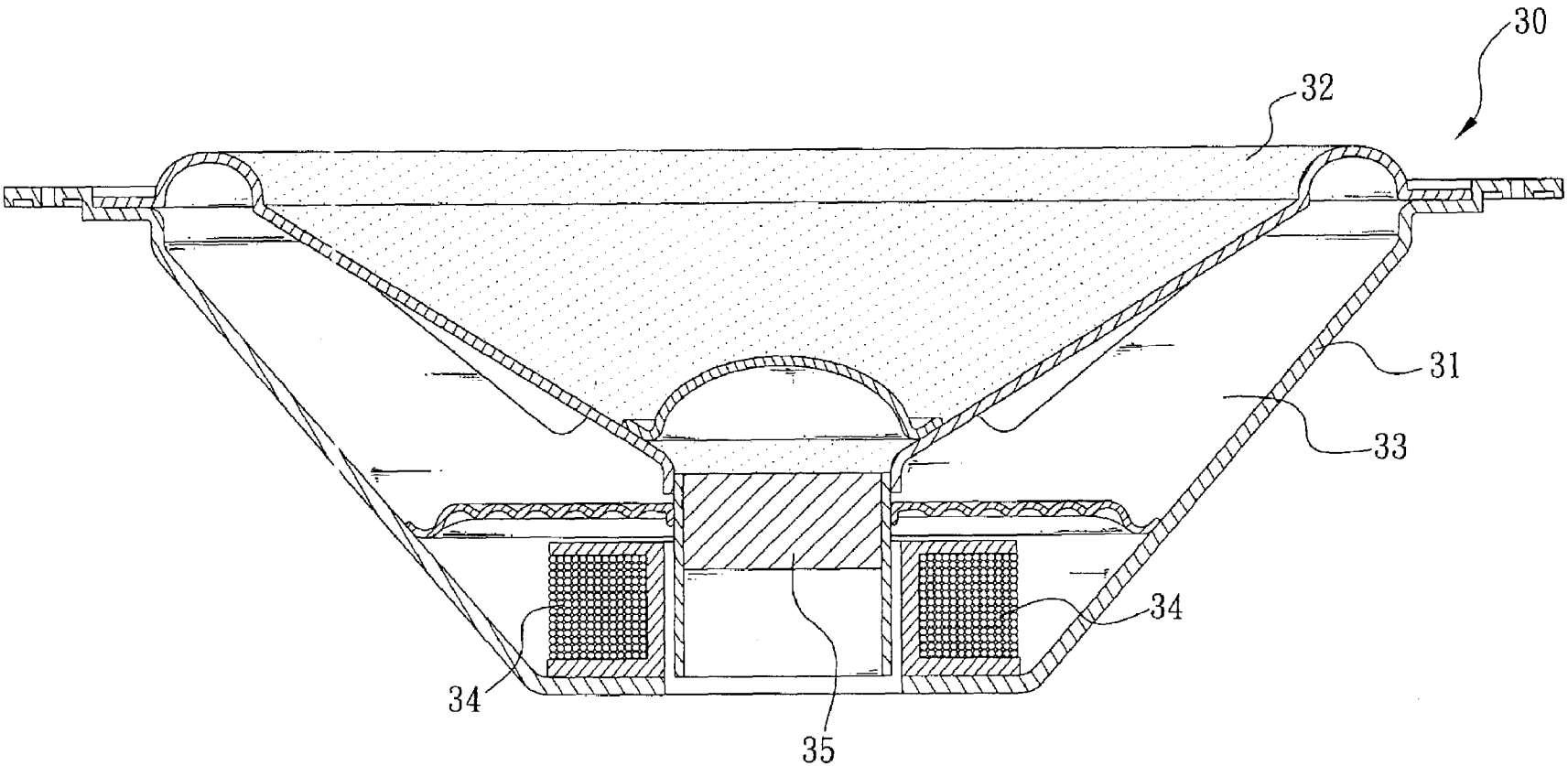
FIG. 2 (Prior Art)
FIG. 2 is a cross-sectional diagram of a speaker in accordance with the inventor's U.S. Pat. No. 6,415,037.
Figure 3:
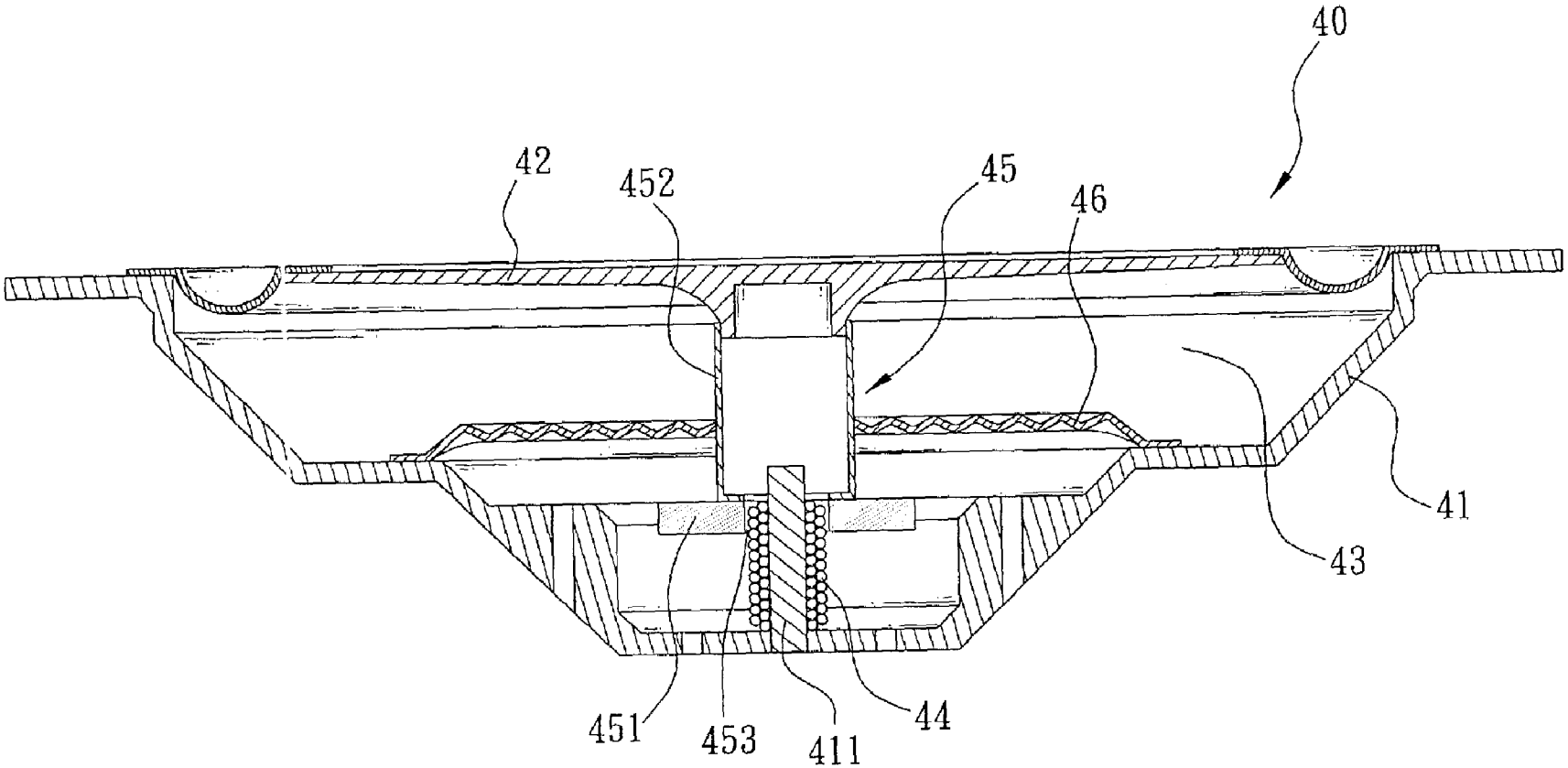
FIG. 3 is a cross-sectional diagram of a speaker of a preferred embodiment of the present invention.

Please refer to the FIG. 3 for a preferred embodiment of the present invention. In the figure, a speaker 40 comprises a frame 41; a concave resonant space 43 defined in the central position on one side of the frame 41; a diaphragm 42 fixed on the periphery of the frame 41, and the diaphragm 42 being extended in the direction towards the resonance space 43; a magnetic member 45 disposed at the central position of the diaphragm 42; a central pillar 411 disposed at the central position of the bottom of the resonant space 43 of the frame 41; a winding disposed on the central pillar 411; a through hole 453 disposed at the central position of the magnetic member 45 facing one end of the resonant space 43, and the diameter of the through hole 453 is slightly larger than the external diameter of the winding 44 such that one end of the magnetic member 45 can exactly pass through the through hole 453 and be movably coupled onto the winding 44.

In this embodiment, the winding 44 is excited when an electric current is flowed through. Then an electromagnetic effect is occurred in the central position of the resonant space 43 to generate magnetic lines, which co-act with the magnetic lines generated by the magnetic member 45 to create an attraction-repulsive effect. As such, the magnetic member 45 may vibrate vertically as the magnitude and direction of current applied on the winding 44 being changed. In turn, the diaphragm 42 is vibrated to generate sound for outputting through the speaker 40.

Figure 4:
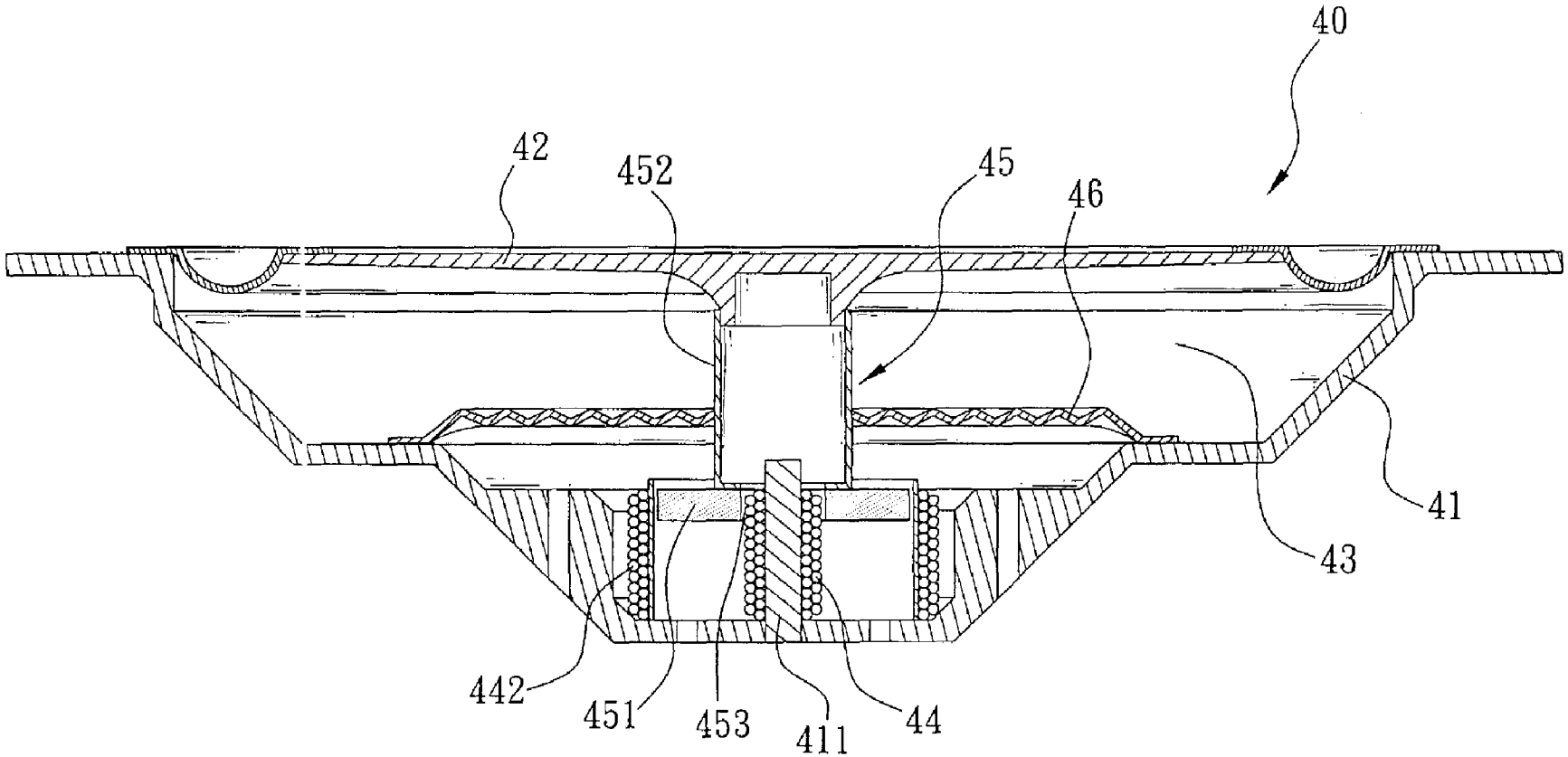
FIG. 4 is a cross-sectional diagram of a speaker of another preferred embodiment of the present invention.

Refer to FIG. 4 for a second preferred embodiment of the present invention. In addition to the winding 44 fixed on the central pillar 411 at the bottom of the resonant space 43, another winding 442 is added, and such winding 442 has an internal diameter larger than the external diameter of the winding 44 to maintain a predetermined gap between the two windings, so that when the windings 44, 442 are excited, the magnetic member 45 vibrates vertically and slides in such gap. The power and volume of the speaker 40 can be controlled easily by flexibly adjusting the number of coils and the magnetic excitation of the windings 44, 442.

In the previous two embodiments, the magnetic member 45 is a permanent magnet having high magnetism with one end fixed on the center of diaphragm 42, while the other end movably coupled to the winding 44 through the through hole 453, or engaged into the gap between the windings 44, 442. Further, in the two embodiments (refer to FIGS. 3 and 4 again), the magnetic member 45 comprises a sleeve 452 and a permanent magnet 451 having high magnetism. The sleeve 452 is a hollow sleeve with one end fixed on the center of the diaphragm 42 while the other end coupled to the permanent magnet 451, so that the through hole 453 at the center of the permanent magnet 451 can be movably coupled to the winding 44, or engaged into the gap between the windings 44 and 442.

In the previous two preferred embodiments (refer to FIGS. 3 and 4 again), a corrugated damping film 46 is provided around the magnetic member 45 or sleeve 452 adjacent to the diaphragm 42 to increase the damping effect of the diaphragm 42 and the magnetic member 45 to adjust the quality and volume of the sound. The damping film 46 is extended along the radial direction to couple with the frame 41 at an appropriate position within the resonant space 43.

Figure 5:
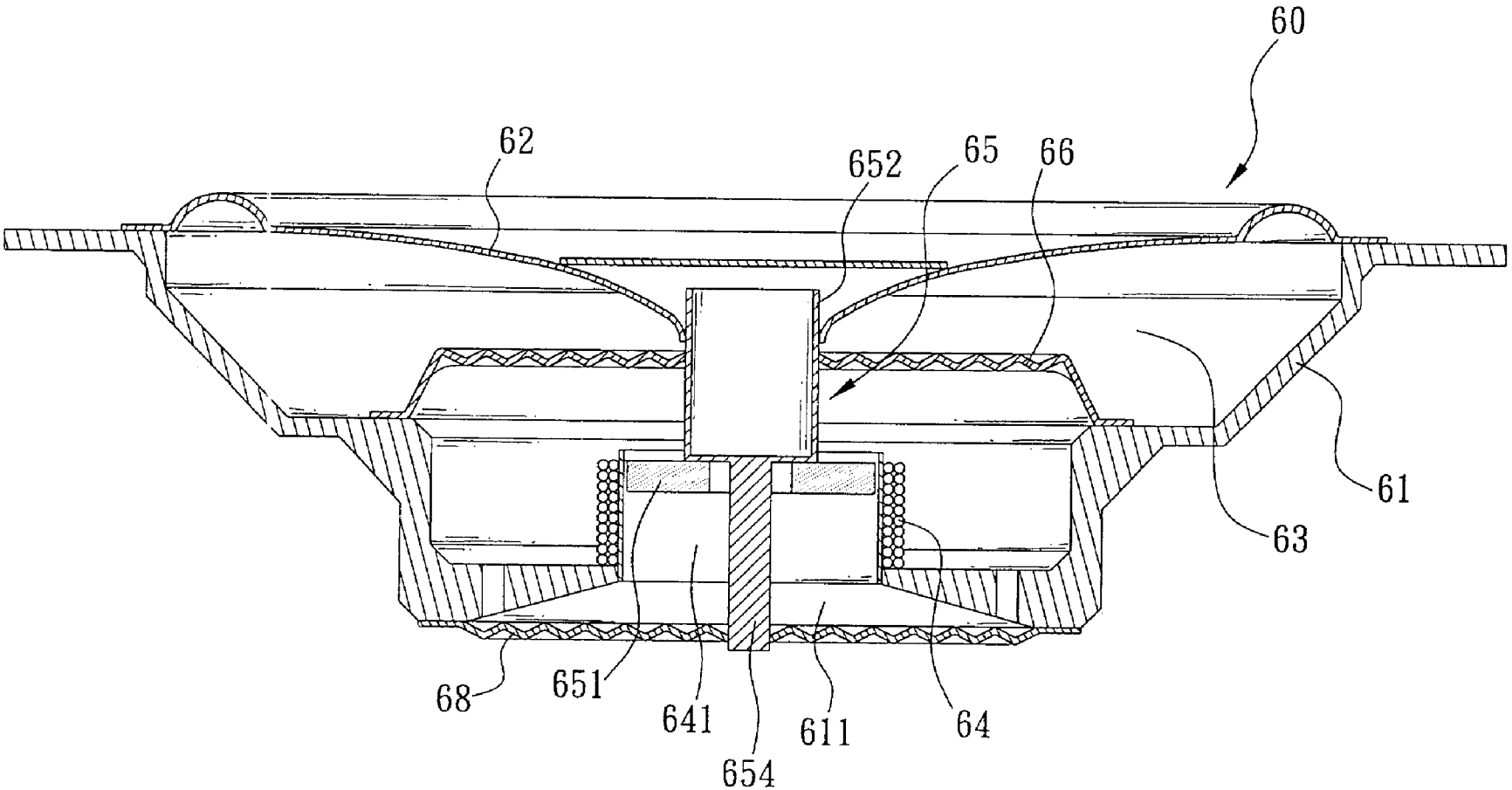
FIG. 5 is a cross-sectional diagram of a speaker of a further preferred embodiment of the present invention.

Please refer to FIG. 5 for another preferred embodiment of the present invention. In the figure, a speaker 60 comprises a frame 61, a concave resonant space 63 defined in the central position on one side of the frame 61; a diaphragm 62 fixed on the periphery of the frame 61, and the diaphragm 62 extends in the direction towards the resonance space 63; a magnetic member 65 disposed at the central position of the diaphragm 62; a central through hole 611 disposed at the central position of the bottom of the resonant space 63 of the frame 61; a winding 64 disposed on inner side of the central through hole 611 facing one side to the resonant space 63; a through hole 641 disposed at the central position of the winding 64, and the diameter of the through hole 641 is slightly larger than the external diameter of the magnetic member 65 such that the other end of the magnetic member 65 can exactly pass through the through hole 641 and slide vertically.

In this embodiment, the winding 64 is excited when an electric current is flowed through. Then an electromagnetic effect is occurred in the central position of the resonant space 63 to generate magnetic lines, which co-act with the magnetic lines generated by the magnetic member 65 to create an attraction-repulsive effect. As such, the magnetic member 65 may vibrate vertically as the magnitude and direction of current applied on the winding 64 being changed. In turn, the diaphragm 62 is vibrated to generate sound for outputting through the speaker 60.

Figure 6:
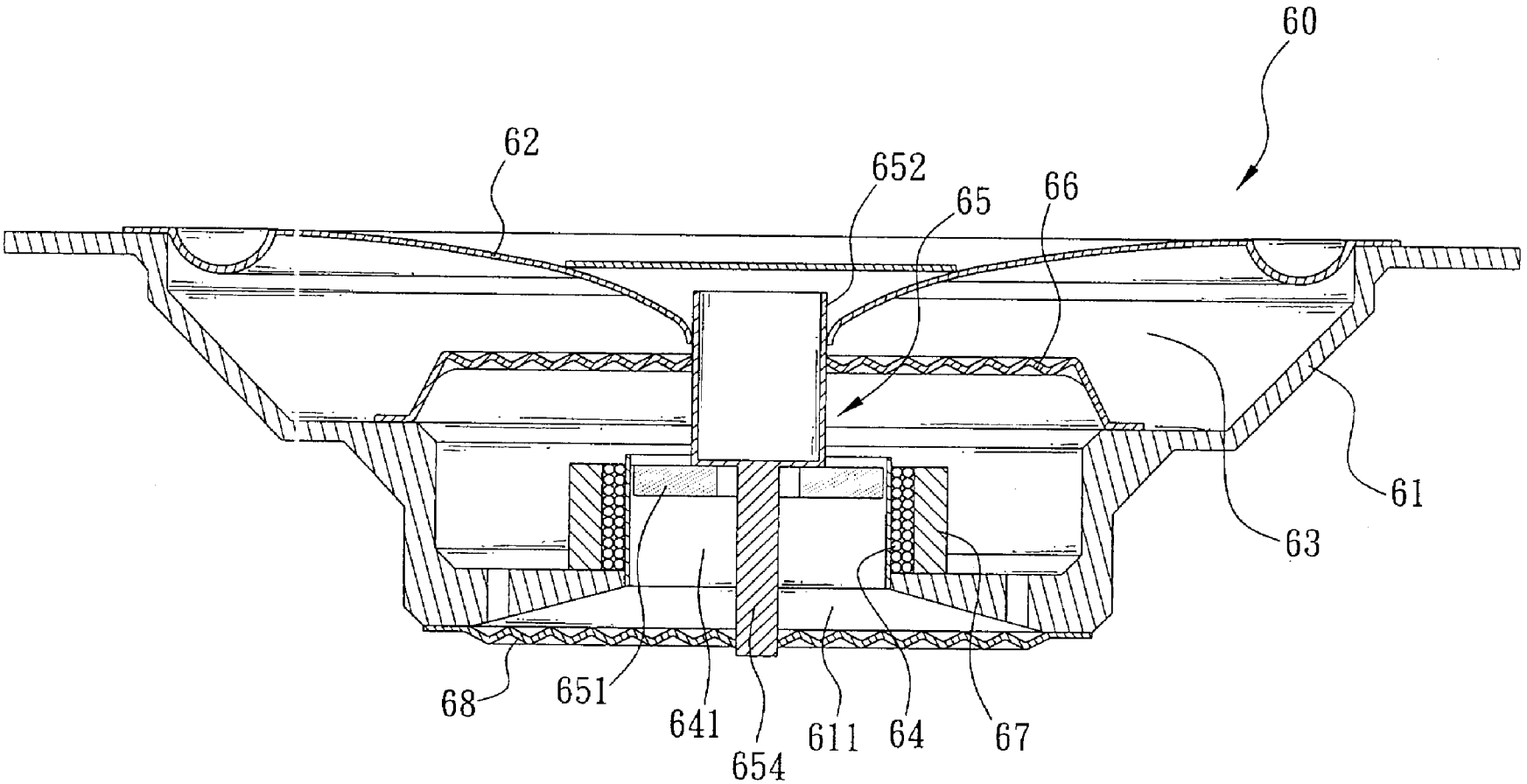
FIG. 6 is a cross-sectional diagram of a speaker of another preferred embodiment of the present invention.

Refer to FIG. 6 for another preferred embodiment of the present invention. In the figure, a core 67 is added to the external rim of the winding 64 at the bottom of the resonant space 63, so that when the winding 64 is excited to generate magnetic lines, the magnetic lines converge towards the position of another through hole 641 disposed at the center of the winding 64 due to the installation of the core 67 to effectively increase the density of the magnetic lines in another through hole 641. In this embodiment, the core 67 can be set on the inner side of the through hole 641 disposed at the center of the winding 64. The core 67 at its center has a through hole with a diameter slightly larger than the external diameter of the magnetic member 65, such that another end of the magnetic member 65 can exactly slide vertically in the through hole. Thus, the present invention can control the power and volume of the speaker 60 easily by flexibly selecting a core 67 of different magnetic coefficients.

In the previous two preferred embodiments, the magnetic member 65 is a permanent magnet having high magnetism with one end fixed on the center of diaphragm 62, and the other end coupled to the winding 64 through the through hole 641. Refer to FIGS. 5 and 6. The magnetic member 65 comprises a sleeve 652 and a permanent magnet 651 having high magnetism. The sleeve 652 is a hollow sleeve with one end fixed on the center of the diaphragm 62 while the other end coupled to the permanent magnet 651, so that the permanent magnet 651 is movably coupled into the through hole 641 at the center of the winding 64.

In the previous two preferred embodiments (refer to FIGS. 5 and 6 again), a corrugated damping film 66 is provided around the magnetic member 65 or sleeve 652 adjacent to the diaphragm 62 to increase the damping effect of the diaphragm 62 and the magnetic member 65 to adjust the quality and volume of the sound. The damping film 66 is extended along the radial direction to couple with the frame 61 at an appropriate position within the resonant space 63. In addition, an auxiliary corrugated damping film 68 can be added to the external rim of the central through hole 611 disposed at the bottom of the resonant space 63 of the frame 61, and a link rod 654 can be added to one end of the magnetic member 65 facing the bottom of the resonant space 63 while another end of the link rod 654 can pass through another through hole 641 disposed at the center of the winding 64 to fix on the central position of the auxiliary damping film 68. Therefore, when the winding 64 is excited and the winding 64 generates varying magnetic lines at the center of the resonant space, the magnetic member 65 slides vertically and steadily within another through hole 641 at the center of the winding 64 by the balance of the damping film 66 and the auxiliary damping film 68 to vibrate the diaphragm 62 and generate sound. This can totally avoid the deviation occurred when the sleeve vibrates vertically and also can effectively increase the travel of the diaphragm and stability, prevent distortion, and significantly enhance the power, quality, and volume of the speaker.

Figure 7:
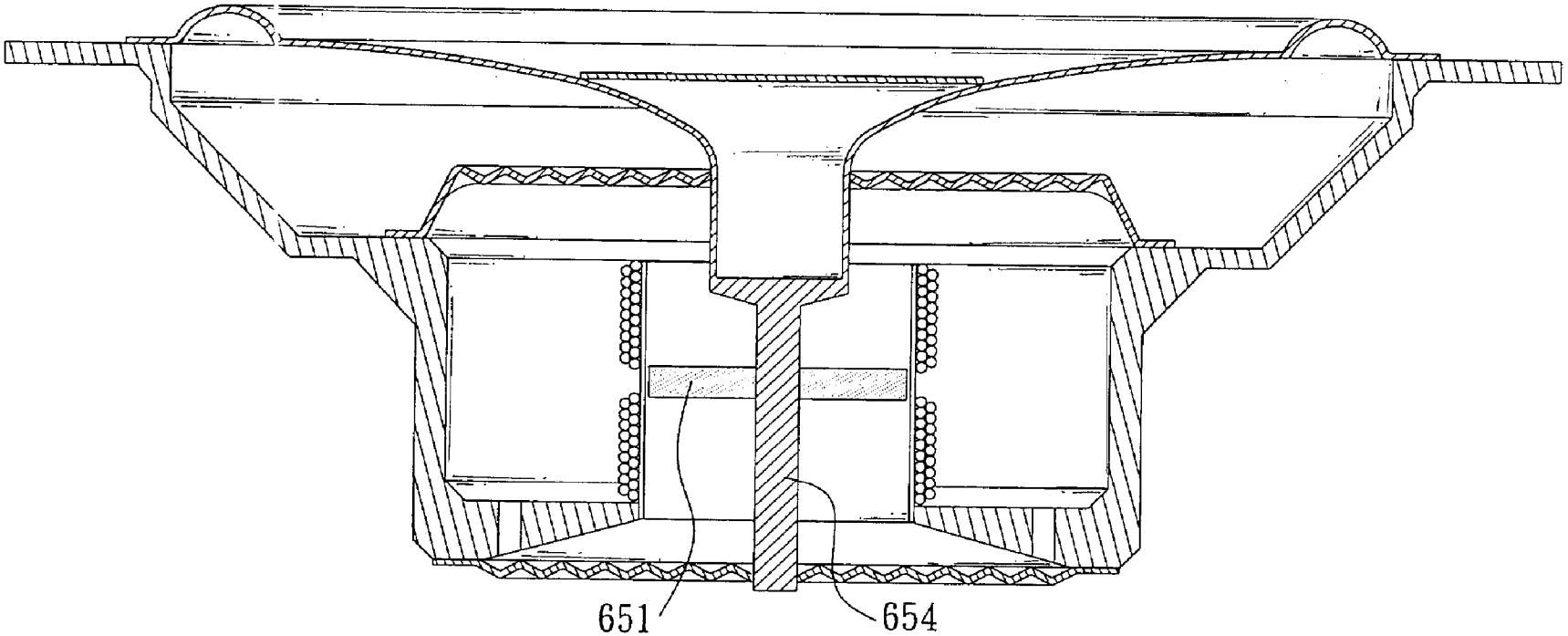
FIG. 7 is a cross-sectional diagram of a speaker of another preferred embodiment of the present invention.

In the aforementioned embodiments of the present invention, the permanent magnet can be directly or indirectly (as referring to FIG. 7, the permanent magnet 651 may be fixed onto an appropriate position at the link rod 654) fixed on the center of the diaphragm such that the space occupied by the components such as the seat, the core and the permanent magnet on the conventional speaker can be effectively reduced, thereby significantly reducing the thickness and the weight of the speaker. In addition, since the winding is directly fixed on the central position of the frame of the speaker, therefore when the winding is excited to create an attraction-repulsion effect directly on the magnetic member and drive the diaphragm to vibrate and generate sound. Such arrangement can effectively simplify the structure of the speaker, lower the cost, increase the travel of the diaphragm, prevent distortion, significantly enhance the low-frequency characteristics, and increase the power.

While the invention has been described by means of specific embodiments, numerous modifications and variations could be made thereto by those skilled in the art without departing from the scope and spirit of the invention set forth in the claims.

What is claimed is:

1. A speaker having a magnetic member installed on a diaphragm, comprising:

a frame, forming a resonant space at the central position on one side of said frame, and having a diaphragm fixed on the periphery of said frame, and said diaphragm extending towards said resonant space;

a central pillar, disposed at the bottom center of said resonant space of said frame;

a winding, fixed on said central pillar;

a magnetic member, having one end coupled to the central position of said diaphragm and a through hole disposed at the center of said magnetic member facing said resonant space, and the diameter of said through hole being slightly larger than the external diameter of said winding, wherein another end of said magnetic member passes through the through hole and is movably coupled to the winding, wherein said magnetic member comprises a corrugated damping film disposed at a position proximate said diaphragm, and said damping film extends alone a radial direction to couple with an appropriate position in said resonant space of said frame.

2. The speaker having a magnetic member installed on a diaphragm of claim 1, wherein said magnetic member further comprises a permanent magnet having high magnetism, with one end directly fixed on the center of said diaphragm while the other end is movably coupled to the winding through the through hole disposed at the center of said magnetic member.

3. The speaker having a magnetic member installed on a diaphragm of claim 1, wherein said magnetic member further comprises:

a sleeve, being a hollow sleeve, with one end fixed on the center of said diaphragm, and a permanent magnet, having one end coupled to another end of the sleeve, such that said through hole disposed at the center of the permanent magnet is movably coupled to the winding.

4. The speaker having a magnetic member installed on a diaphragm of claim 1, wherein said resonant space at a position proximate the bottom of the resonant space comprises another winding, and said another winding has an internal diameter larger than the external diameter of said winding and keeps a predetermined gap between the two windings, wherein the magnetic member is excited by said winding to vibrate vertically and slide in the gap.

5. A speaker having a magnetic member installed on a diaphragm, comprising:

a frame, forming a resonant space at the central position on one side of said frame, and having a diaphragm fixed on the periphery of said frame and extending towards said resonant space, and having a central through hole disposed at the bottom center of said resonant space of said frame;

a magnetic member, having one end coupled to the central position of said diaphragm; and a winding, coupled to an inner side of said central through hole on the side facing said resonant space, and another through hole disposed at the center of said winding, and the diameter of said through hole being slightly larger than the external diameter of said magnetic member, wherein another end of said magnetic member slides vertically within said through holes, wherein said magnetic member comprises a corrugated damping film disposed at a position proximate said diaphragm, and said damping film extends along a radial direction to couple with an appropriate position in said resonant space of said frame.

6. The speaker having a magnetic member installed on a diaphragm of claim 5, wherein said magnetic member further comprises a permanent magnet having high magnetism, with one end directly fixed on the center of said diaphragm while the other end is movably coupled to the winding through the through hole disposed at the center of said magnetic member.

7. The speaker having a magnetic member installed on a diaphragm of claim 5, wherein said magnetic member further comprises:

a sleeve, being a hollow sleeve, with one end fixed on the center of said diaphragm, and a permanent magnet, having one end coupled to another end of the sleeve, such that said through hole disposed at the center of the permanent magnet is movably coupled to the winding.

8. The speaker having a magnetic member installed on a diaphragm of claim 5, wherein said frame comprises an auxiliary damping film disposed at the periphery of the central through hole at the bottom of said resonant space, and a link rod at the end of said magnetic member facing said resonant space, and the other end of said link rod passes through the through hole at the center of said winding to couple to the center of said auxiliary damping film.

9. The speaker having a magnetic member installed on a diaphragm of claim 8, wherein said winding disposed at the bottom of said resonant space comprises a core at the outer edge of said winding.

10. The speaker having a magnetic member installed on a diaphragm of claim 8, wherein said through hole at the inner edge of said winding comprises a core at the center of said through hole, and the core at its center comprises a through hole with a diameter slightly larger than the external diameter of the magnetic member, such that another end of the magnetic member is capable of sliding vertically within said through hole.

* * * * *